United States Patent [19]

Peters

[11] 4,319,368

[45] Mar. 16, 1982

[54] TODDLER-PROOF LATCH FOR TOILET FLUSH LEVER

[76] Inventor: Judith A. Peters, 4307 Gilbert St., Oakland, Calif. 94611

[21] Appl. No.: 215,505

[22] Filed: Dec. 11, 1980

[51] Int. Cl.[3] ..... A47K 17/00

[52] U.S. Cl. ..... 4/661; 4/415; 4/253

[58] Field of Search ..... 4/661, 415, 253; 292/108, 347, 288, 340, 376; 251/285

[56] References Cited

U.S. PATENT DOCUMENTS

| | | | |
|---|---|---|---|
| 3,358,294 | 12/1967 | Nolan et al. | 4/661 |
| 3,719,957 | 3/1973 | Riedel | 4/415 X |
| 3,745,591 | 7/1973 | Girten | 4/415 X |

*Primary Examiner*—Henry K. Artis

*Attorney, Agent, or Firm*—Flehr, Hohbach, Test, Albritton & Herbert

[57] ABSTRACT

A toddler-proof latch for a toilet flush lever having a housing adapted to be mounted to the wall of a water closet in a prearranged position in the vicinity of the flush lever. An actuating mechanism is carried at least partially within the housing and is manually actuable from a latching position to an unlatching position. A spring biasing arrangement is provided for the actuating mechanism to bias it towards the latching position. A latch arrangement is carried on either the housing or the actuator means and operates in response to the actuator means to prevent operation of the toilet flush lever when the actuator means is in the spring biased latching position and permits operation of the flush lever when the actuating mechanism is in the manually actuated unlatching position. Various embodiments adapted to mount over the toilet flush lever or adjacent to the flush lever are disclosed. A locking mechanism for the actuating means to selectively lock it into an unlatching position is also disclosed.

8 Claims, 6 Drawing Figures

TODDLER-PROOF LATCH FOR TOILET FLUSH LEVER

This invention relates generally to child-proof latches and, more specifically, to a child-proof latch assembly for a toilet flush lever.

A substantial number of families have pre-school children in the age range between one and three years who have a fascination with flushing the toilet. As a result, these children will often enter the bathroom and flush the toilet several times before an adult discovers the child at this action. This behavior pattern not only frustrates the parents but causes a very substantial wasting of increasingly scarce fresh water resources throughout the country.

A toilet handle lock is proposed in Nolan et al. U.S. Pat. No. 3,358,294. While the Nolan et al. flush lever lock would generally satisfy the purpose of preventing small children from unnecessarily flushing the toilet, it does not provide for automatic return of the locking mechanism to the lock position after it has been placed in an unlocked position to permit flushing of the toilet. Consequently, it is highly probable that frequently an adult or older child flushing the toilet will neglect to return the lock to the latch position after flushing the toilet.

Accordingly, it is a principle object of this invention to provide an improved toddler-proof latch for a toilet flush lever.

It is a further object of this invention to provide a toilet flush lever latch which is manually positionable to an unlatched position and automatically returns to a latched position after the flush lever is operated and released.

It is a further object of this invention to provide a toilet flush lever latch which is easily mounted to the water closet wall of the toilet by the average person.

It is a further object of this invention to provide a toilet flush lever latch which may be manufactured from a few molded plastic components at low cost.

This invention generally features a latch for an externally mounted, rotatable toilet flush lever mounted on a wall of a water closet and having a hub and a lever arm extending from the hub. The latch comprises a housing adapted to be mounted to the wall of the water closet in a prearranged position in the vicinity of the flush lever. Actuating means is carried at least partially within the housing and is manually actuable from a latching position to an unlatching position. Spring means are provided for biasing the actuating means toward the latching position, and a latch means is carried on one of the housing and the actuator means and is operative in response to the actuator means for preventing operation of the flush lever when the actuator means is in the spring biased latching position and permitting operation of the flush lever when the actuating means is in the manually actuated unlatching position.

One embodiment of the invention features a housing which is a generally hollow structure having a rear wall portion adapted to mount to the wall of the water closet. The actuator means comprises an actuator block having at least a main body portion mounted within the housing to reciprocate between a forward latching position and a rearward unlatching position and a secondary body portion extending outside the housing to permit manual operation of the actuator block. The spring means comprises at least one compression spring mounted between an interior surface of the rear wall of the housing and a rearward facing wall of the actuator block to maintain the actuator block in the latching position in absence of manual actuation force on the secondary body portion thereof. The latch means comprises a latch bar carried on the actuating block in a location which is positioned below the lever arm of the flush lever when the housing is mounted in its prearranged position with respect to the flush lever with the latch bar being positioned directly underneath the lever arm when the actuator block is in the latching position to prevent operation of the flush lever and being positioned behind the lever arm when the actuator block is in the unlatching position to permit operation of the flush lever. This embodiment has two variations, one in which the housing and actuator block are adapted to mount directly over the hub of the flush lever and a second variation in which the housing is adapted to be mounted beneath the flush lever of the toilet.

In another embodiment of this invention, the housing is also adapted to be mounted to the water closet in a position generally adjacent to and below the hub of the flush lever. In this embodiment the actuator block has a central cavity portion located within a rear section of the main body portion thereof and a stop bar carried on the actuating block behind the cavity. The latch means comprises a latch bar rotatably mounted to a left side wall of the housing with a latch arm portion extending from the housing to contact the lever arm on the flush lever and a stop arm portion adapted to contact the stop bar on the actuating block when the actuating block is in the latching position and to rotate within the cavity of the actuating block when the actuating block is in the unlatching position. The latch means further includes spring means mounted between the housing and the latch bar to urge the latch arm part of the latch bar against the lever arm. In this fashion, the latch bar prevents operation of the flush lever when the actuating block is in the spring-biased latching position with the stop arm portion in contact with the stop bar and the latch bar permits operation of the flushed lever when the actuating block is in the manually actuated unlatching position and the stop arm portion thereof is free to rotate within the cavity in the actuating block.

The various embodiments of the toilet flush lever latch of this invention all have the advantageous feature of automatic return of the latching means and the actuating means to the latched position after operation of the flush lever to flush the toilet. All of the embodiments of the invention are readily mounted by unskilled personnel to the water closet wall on which the flush lever is located utilizing double-faced adhesive tape on the back wall of the housing of the latch assembly. The various embodiments of the invention permit it to be utilized with virtually all versions of toilet flush levers. Relatively few, inexpensive components are involved so a relatively low cost latch is provided. The structure of the latch is such that the latching mechanism is not apparent to the child watching an adult operate the latch and thus the technique is unlikely to be mastered by the small child. At the same time, the technique for operating the latch is easy to master by the older child who can be trusted not to flush the toilet unnecessarily. Returning the latch bar automatically to the latching position after the flush lever has been operated and the actuator block is released eliminates the possibility that the flush lever will remain unlatched for the small child to operate. The latch assembly of this invention thus provides a simple but very effective solution to toddler-proofing the toilet.

Other objects, features, and advantages of this invention will be apparent from a consideration of the following detailed description taken in conjunction with the accompanying drawings.

Figure 2:
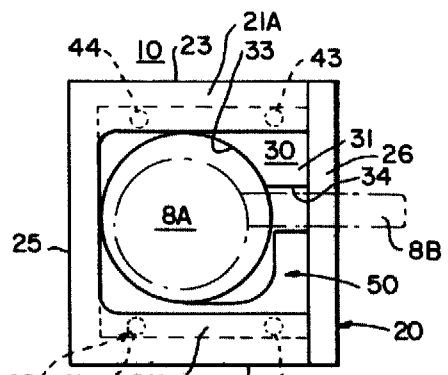
FIG. 2 is a back elevational view of the toddler-proof latch of FIG. 1 taken along the lines 2—2.
Figure 1:
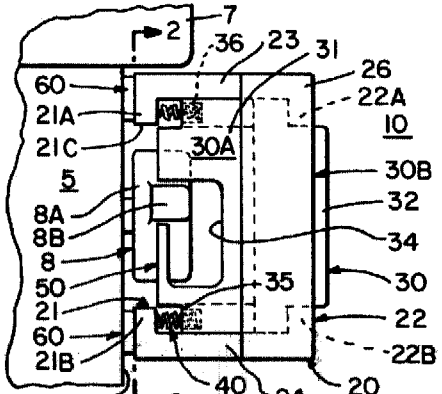
FIG. 1 is a side elevational view of one embodiment of a toddler-proof toilet flush lever latch in accordance with this invention.

Referring now to FIGS. 1 and 2, one embodiment of a toddler-proof toilet flush lever latch 10 which is adapted to be mounted over the toilet flush lever 8 will be described. The toddler-proof latch 10 is intended to be utilized on a water closet 5 which has the toilet flush lever 8 located a sufficient distance below the cover 7 of the water closet to provide clearance for the latch 10 to be mounted over the flush lever 8. Flush lever 8 generally consists of two portions, a hub 8A and a lever arm 8B extending outward from the hub. On most toilet water closets the lever arm 8B is designed to provide some clearance between the back of the lever arm and the front wall 6 of the water closet, and the toddler-proof latch 10 is designed for use with flush levers having this clearance. As will later be seen, other embodiments of the toddler-proof latch of this invention may be used universally on toilet flush levers regardless of whether clearance is provided between the top of the flush lever hub and the water closet cover or whether there is clearance between the lever arm of the flush lever and the front surface of the water closet wall.

The general components of the toddler-proof latch assembly 10 comprise a housing 20, an actuating block 30, a spring biasing arrangement 40, and a latch means in the form of a latch bar 50. The housing 20 is adapted to be mounted to the front wall 6 of the water closet 5 by means of double-sided adhesive tape 60 which may, for example, be strips of double coated neoprene foam tape No. 4262 available from the 3M Company as part No. 02120-12423. Any double-sided adhesive tape having sufficient adhesive strength to hold the latch assembly 10 on the porcelain surface of the water closet may be utilized for this application. Housing 20 generally comprises a back wall 21, a front wall 22, a top wall 23, a bottom wall 24, a substantially complete right side wall 25, and a partial left side wall 26. Back wall 21 has a central opening 21C therein which defines the upper and lower shoulder portions 21A and 21B extending inwardly from the top wall 23 and bottom wall 24, respectively. Similarly front wall 22 has a central opening which defines shoulder portions 22A and 22B extending inwardly from the top wall 23 and bottom wall 24, respectively.

Actuator block 30 has a main body portion 31 which is generally cube-shaped and has vertical and horizontal dimensions which provide a close fit thereof within the cube-shaped interior cavity of housing 20. A secondary body portion 32 of actuator block 30 extends through the opening in front wall 22 and has vertical and horizontal dimensions which provide a close but sliding fit thereof within the front wall opening. A back portion of the main body section 31 has a reduced height region forming the vertical shoulders 35 which permits the actuator block 30 to reciprocate between a forward latching position (shown in FIG. 5) with a front wall of the main body portion 31 abutting the front shoulder portions 22A and 22B of front wall 22 and a rearward unlatching position with the vertical shoulders 35 abutting the back shoulder portions 21A and 21B.

The main body section 31 has a large cavity 33 formed therein which is adapted to fit over the hub 8A of the flush lever 8 when the housing is mounted to the front wall 6 of the water closet 5. A side opening 34 is provided in the main body portion 31 to accommodate the lever arm 8B. A latch means 50 in the form of a latch bar is carried on the actuator block 30 in the back region of side opening 34 as shown in FIGS. 1 and 2. Accordingly, when actuator block is in the forward latching position, the latch bar 50 is located directly underneath the lever arm 8B and the flush lever 8 is prevented from operating. When the actuator block 30 is in the rearward unlatching position, the latch bar 50 is positioned behind the lever arm 8B and lever arm 8B may be pushed downwardly within opening 34 to flush the toilet.

Spring means 40 in the form of four compression springs 41–48 are mounted between the inward facing walls of the back shoulder portions 21A and 21B and rearward facing walls of the shoulders 35 on actuator block 30. To hold compression springs 41–44 in position apertures 36 may be formed in the vertical shoulder 35 of the actuator block 30. The compression springs 41–44 bias actuator block 30 towards its forward latch position so that manual force is required to be applied to the actuator block 30 to move it to its rearward unlatching position.

With the toddler-proof latch 10 mounted on the water closet, it will be apparent that the spring biasing means 40 normally maintains the latch bar 50 in its latched position, preventing operation of the flush lever arm 8B. To enable the lever arm 8B to be operated, the actuating block 30 is manually depressed and held in the depressed position while the lever arm 8B is first depressed and then released to flush the toilet. When the actuator block 30 is thereafter released it automatically returns to the forward latching position carrying the latch bar 50 with it.

Figure 5:
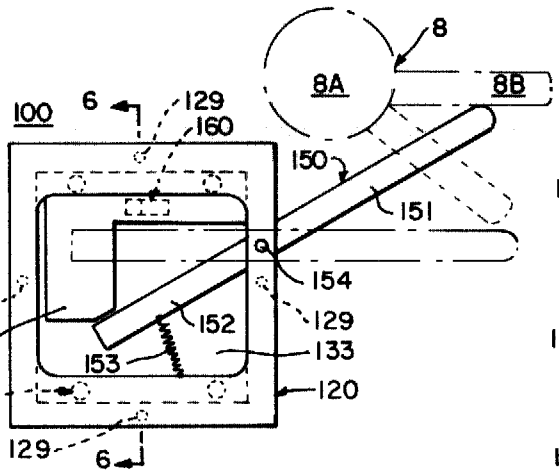
FIG. 5 is a back elevational view of the toddler-proof latch of FIG. 4 taken along the lines 5—5.
Figure 4:
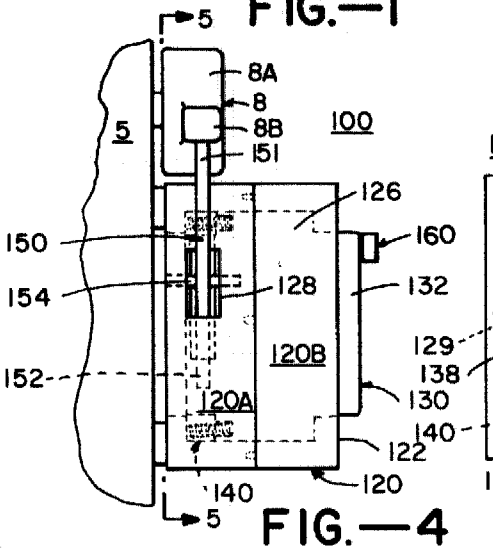
FIG. 4 is a side elevational view of an alternative embodiment of a toddler-proof toilet flush lever latch in accordance with this invention.

The toddler-proof latch 10 as shown in FIGS. 1 and 2 may be formed principally of plastic molded components. For example, housing 20 may be a single molded plastic unit as illustrated in FIG. 1. Alternatively it could be a two-piece unit which snaps together generally in the manner shown in the embodiment of FIGS. 4, 5, and 6 which will be described below. If the housing 20 is a single molded plastic unit, for purposes of ease of assembly, it is preferable that the actuator block 30 be formed of two separate units 30A and 30B. The section 30B may first be inserted into housing 20 and permitted to drop to the front wall thereof, after which the second section 30A may be inserted through the open portion of the left side wall 26. The compression springs 41 through 44 may then be inserted into the apertures 36 and the assembly is complete. If the housing 20 is made in split sections as shown in FIGS. 4 and 5, then the actuator block 30 may be formed of one molded plastic part and positioned within the housing before the two pieces thereof are snapped together. Thereafter the compression springs 41 through 44 may be inserted as before.

Figure 3:
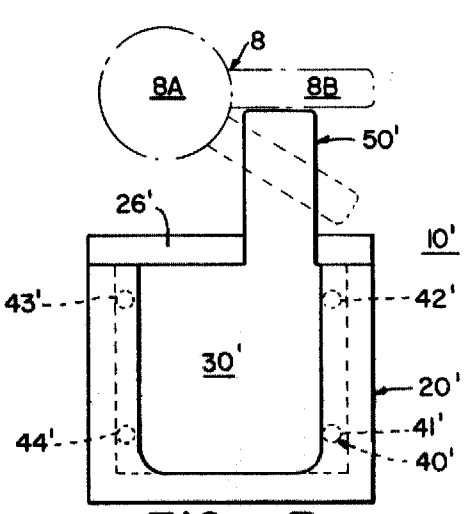
FIG. 3 is a back elevational view of an alternative embodiment of a toddler-proof toilet flush lever latch in accordance with this invention.

FIG. 3 illustrates an alternative embodiment 10' of a toddler-proof flush lever latch. The housing 20' may be substantially identical to the housing 20 shown in FIGS. 1 and 2 and described above. The actuator block 30' is different from the actuator block 30 and may comprise a solid block since the housing 20' is adapted to be mounted below the flush lever 8. As will be seen from FIG. 3 the housing 20' is rotated ninety degrees with respect to the housing 20 in FIGS. 1 and 2 in mounting it on the front wall of the water closet. A latch bar 50' extends outwardly from the partial wall 26' and extends up underneath the lever arm 8B of flush lever 8. The latch bar 50' is mounted to the actuator block 30' in such a position that it sits immediately under the lever arm 8B when actuator block 30' is in the forward latching position and is located behind the lever arm 8B when the actuator block 30' is positioned in its rearward unlatching position.

The embodiment of FIG. 3 may be employed in any toilet arrangement where the lever arm 8B of the flush lever 8 has sufficient clearance between it and the front wall of the water closet. It will be appreciated that the embodiment of FIG. 3 could utilize a much smaller housing since it is not required to mount over the flush lever. However, the embodiment of FIG. 3 may also utilize the same housing as the embodiment of FIGS. 1 and 2 in the event that it is desired to manufacture different models of the toddler-proof latch of this invention utilizing some standard components to save manufacturing cost.

It should be apparent that the embodiments of FIGS. 1 and 2 and FIG. 3 could be altered to reverse the latching and unlatching positions of the actuator block 30 (30'). In other words, the rearward position of the actuator block 30 could be the latched position and be established by compression springs mounted between the front shoulder portion 22A and 22B and the front wall portions of the actuator block 30. In this alternative approach a handle would be required for pulling actuator block 30 forward against spring pressure of the compression springs and the latch bar 50 will be pulled forward with the actuator block 30 to be positioned in front of the lever arm 8B in the unlatching position of actuator block 30. It will be appreciated that one or the other of these alternatives embodiment would be adaptable to virtually all toilet flush levers regardless of whether they have clearance between the flush lever and the front wall of the water closet.

Manufacture of a latch assembly using this alternative approach would preferably involve the use of a split housing so that the compression springs 41'–43' could be readily positioned prior to snapping the housing together. The embodiments shown in FIGS. 1 through 3 are preferred, however, since the use of a pushing force on the actuator block 30 tends to push the housing 20 against the front wall surface 6 of the water closet 5 and thus does not exert a pulling force against the double-sided adhesive 60.

Figure 6:
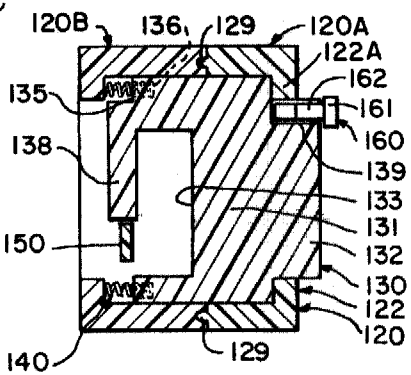
FIG. 6 is a sectioned side elevational view of the toddler-proof latch of FIG. 5 taken along the lines 6—6.

FIGS. 4, 5 and 6 illustrate another alternative version of a toddler-proof latch. Generally the housing 120 in the latch assembly 100 is substantially the same as the housing 20 previously described except that the left wall 126 is a substantially complete wall and has an opening 129 therein through which extends a latch means 150 in the form of an elongated latch bar. Latch bar 150 is rotatably mounted in opening 128 using a pin arrangement 154. The actuator block 130 in the embodiment of FIGS. 4 and 5 has a different structure than that of the actuator block 30 shown in FIGS. 1 and 2 and this structure is particularly shown in the cross section of FIG. 6. As can be seen in FIG. 6, the actuator block 130 also includes a main body section 131 which has a generally cube shape which fits within the interior of housing 120. The secondary body portion 132 extends through the opening in the front wall of housing 120 as in the embodiment of FIGS. 1 and 2. A cavity 133 is provided in the rear portion of actuator block 130 with a stop block portion 138 carried on actuator block 130 behind cavity 133.

The elongated latch bar 150 includes a latch arm portion 151 extending outward from housing 120 to contact lever arm 8B on flush lever 8. Latch bar 150 further includes a stop arm portion 152 extending into housing 120 and adapted to contact stop bar 138 when actuator block 130 is in its rearward latching position. Stop arm portion 152 is, however, free to rotate within cavity 133 when actuator block 130 is in its rearward unlatching position. A tension spring 153 is mounted between the housing 120 and the latch bar 150 to urge the latch arm portion 151 thereof against the lever arm 8B of the flush lever 8. Accordingly, when actuator block 130 is in its forward latching position and stop arm portion 152 of latch bar 150 is in contact with stop bar 138, operation of flush lever 8 is prevented. However, when actuator block 130 is manually actuated to its rearward unlatching position, lever arm 8B is free to operate. As it operates, it pushes stop arm portion 152 into cavity 133. When lever arm 8B is released after the toilet is flushed, the tension spring 153 returns the latch bar 150 to its normal position and, upon release of the actuator block 130, it resumes its latching position in which operation of the flush lever 8 is prevented.

The toddler-proof latch 100 optionally incorporates a locking mechanism 160 which enables the actuator block 130 to be locked into its unlatching position. Locking mechanism 160 comprises an L-shaped key 162 which rides in an L-shaped keyway 139 in the top of secondary body portion 132 of actuator block 130 and a knob 161 extending in front of actuator block 130. The knob 161 may be used when the actuator block 130 is in its unlatching position to rotate L-shaped key 162 into a position behind the vertical shoulder portion 122A of front wall 122 of housing 120. Then when actuator block 130 is released, the key 162 prevents its return to the latching position. A similar locking mechanism could, of course, be provided in the FIGS. 1 and 2 and FIG. 3 embodiments of this invention.

This locking mechanism would be useful in residences where small toddlers are infrequent visitors so that the latch can be deactivated when toddlers are not present.

As shown in FIGS. 4 and 5, housing 120 is preferably formed as a split plastic housing which may be snapped together using retaining pins 129. The retaining pins 129 may be utilized to hold the housing together or alternatively the housing may be glued together with the pins 129 providing appropriate alignment between the back section 120A and the front section 120B. A split housing readily permits the actuator block 130 to be mounted within the housing. To assemble the toddler-proof latch 100, the latch bar 150 may first be mounted within the back section 120A of housing 120 using the mounting pin 154. The tension spring 153 may be attached to the latch bar 150 and the housing 120 using any conventional approach to hold the latch bar 150 in its normal latching position. Thereafter, the optional locking mechanism 160 may be positioned in the actuator block 130, and actuator block 130 may then be positioned within the front half 120B of housing 120. The back half 120A may then be snapped over the front half 120B. This completes the assembly and the toddler-proof latch 100 is then ready to be utilized.

While the toddler-proof flush lever latch of this invention has been described above in connection with various alternative embodiments, it should be apparent that numerous modifications could be made therein without departing from the scope of this invention. For example, the secondary body portion of the actuator block in each embodiment could exit the housing at a number of different locations providing manual access to the actuator block for repositioning it from its spring biased latching position to its manually actuated unlatching position. Furthermore, the actuating means and the latch means carried thereon in the embodiments of FIGS. 1 through 3 could take a number of different forms, each having the feature of automatically positioning the actuating means and the latch means in a latching position upon release of the actuating means.

It should be apparent that the latch bar and actuating block arrangement of the embodiments of FIGS. 4 and 5 could readily take on many alternative forms. For example, the latch bar 150 could have an L-shaped configuration which would permit the housing 120 to be mounted more directly underneath the hub 8A of the flush lever 8. In addition, numerous other approaches could be provided to implement a locking mechanism for the actuator block. It should thus be appreciated that numerous changes could be made in the various embodiments of the invention discussed above without departing from the scope of the invention as claimed in the following claims.

What is claimed is:

1. A latch for an externally mounted, rotatable toilet flush lever mounted on a wall of a water closet and having a hub and a lever arm extending from said hub, said latch comprising:

a housing adapted to be mounted to said wall of said water closet in a prearranged position in the vicinity of said flush lever;

actuating means carried at least partially within said housing and manually actuable from a latching position to an unlatching position;

spring means for biasing said actuating means towards said latching position; and latch means carried on one of said housing and said actuator means and operative in response to said actuator means for preventing operation of said flush lever when said actuator means is in said spring biased latching position and permitting operation of said flush lever when said actuating means is in said manually actuated unlatching position.

2. Apparatus as claimed in claim 1, wherein said housing is a generally hollow structure having a rear wall portion adapted to mount to said wall of said water closet; said actuator means comprises an actuator block having at least a main body portion mounted within said housing to reciprocate between a forward latching position and a rearward unlatching position and a secondary body portion extending outside said housing to permit manual operation of said actuator block; said spring means comprises at least one compression spring mounted between an interior surface of said rear wall of said housing and a rearward facing wall of said actuator block to maintain said actuator block in said latching position in absence of manual actuation force on said secondary body portion thereof; and said latch means comprises a latch bar carried on said actuating block in a location which is positioned below said lever arm of said flush lever when said housing is mounted in said prearranged position with respect to said flush lever, said latch bar being positioned directly underneath said lever arm when said actuator block is in said latching position to prevent operation of said flush lever and being positioned behind said lever arm when said actuator block is in said unlatching position to permit operation of said flush lever.

3. Apparatus as claimed in claim 2, wherein said housing has openings in the rear and left side wall portions thereof permitting said housing to be mounted directly over said hub of said flush lever with at least a portion of said lever arm extending through said open side wall portion; said main body portion of said actuator block has a rearward facing cavity formed therein and adapted to receive said hub of said flush lever with operating clearance between side and end walls thereof and an opening in a left wall portion of said actuator block to accommodate said lever arm; and said latch bar is positioned within said opening in said left wall portion of said actuator block.

4. Apparatus as claimed in claim 2, wherein said housing is generally cube-shaped with front and back walls, top and bottom walls, and right and left side walls forming a cube-shaped interior cavity, said front and back walls having centrally disposed openings therein defining front and back shoulder portions extending inward from at least said top and bottom walls, said left side wall being a partial wall covering a portion of the depth of said housing and said top, bottom, and right side walls being substantially solid wall sections; said main body portion of said actuator block is generally cube-shaped with horizontal and vertical dimensions providing close fit thereof within said interior cavity of said housing and said secondary body portion is generally cube-shaped with vertical and horizontal dimensions providing close fit thereof within said opening in said front wall of said housing, said main body portion having a back portion of reduced height forming vertical top and bottom shoulders and permitting said actuator block to reciprocate within said housing between a forward latching position with a front wall of said main body portion abutting said front shoulder portions of said housing and a rearward unlatching position with said vertical shoulders on said main body portion abutting said back shoulder portions of said housing; at least two apertures are located at spaced locations on each of said vertical shoulders of said main body portion of said actuator block, and compression springs are positioned partially within said apertures and extending to said back shoulder portions of said housing to urge said actuator block towards said latching position in absence of counteracting manual force applied to said secondary body portion of said actuator block.

5. Apparatus as claimed in claim 4, wherein said main body portion of said actuator block has a rearward facing cavity formed therein and adapted to receive said hub of said flush lever with operating clearances between side and end walls thereof and an opening in a left wall portion of said cavity to accommodate said lever arm such that said housing and said actuator block are adapted to be mounted directly over said hub of said flush lever with at least a portion of said lever arm extending through said opening and beyond said partial left side wall of said housing; and said latch bar is positioned within said opening in said left wall portion of said actuator block.

6. Apparatus as claimed in claim 1, wherein said housing is a generally hollow structure having a rear wall portion adapted to mount to said wall of said water closet in a position generally adjacent to and below said hub of said flush lever; said actuator means comprises an actuator block having at least a main body portion mounted within said housing to reciprocate between a forward latching position and a rearward unlatching position and a secondary body portion extending outside said housing to permit manual operation of said actuator block, said actuator block having a central cavity portion located within a rear section of said main body portion and a stop bar carried on said actuator block behind said cavity; said spring means comprises at least one compression spring mounted between an interior surface of said rear wall of said housing and a rearward facing wall of said actuator block to maintain said actuator block in said latching position in absence of manual actuation force on said secondary body portion thereof; and said latch means comprises a latch bar rotatably mounted to a left side wall of said housing with a latch arm portion extending outward from said housing to contact said lever arm on said flush lever and a stop arm portion extending into said housing and adapted to contact said stop bar on said actuator block when said actuator block is in said latching position and to rotate within said cavity of said actuator block when said actuator block is in said unlatching position, and spring means mounted between said housing and said latch bar to urge said latch arm portion of said latch bar against said lever arm of said flush lever, said latch bar thereby preventing operation of said flush lever when said actuator block is in said latching position and said stop arm portion of said latch bar is in contact with said stop bar and permitting operation of said flush lever when said actuator block is in said unlatching position and said stop arm portion of said latch bar is free to rotate within said cavity in said actuator block.

7. Apparatus as claimed in claim 6, wherein said housing is generally cube-shaped with front and back walls, top and bottom walls, and right and left side walls forming a cube-shaped interior cavity, said front and back walls having centrally disposed openings therein defining front and back shoulder portions extending inward from at least said top and bottom walls, said top, bottom, left and right side walls being substantially solid wall sections with said left side wall having an opening therein in registration with said lever arm of said flush lever when said housing is mounted on said water closet wall; said main body portion of said actuator block is generally cube-shaped with horizontal and vertical dimensions providing close fit thereof within said interior cavity of said housing and said secondary body portion is generally cube-shaped with vertical and horizontal dimensions providing close fit thereof within said opening in said front wall of said housing, said main body portion having a back portion of reduced height forming vertical, top and bottom shoulders and permitting said actuator block to reciprocate within said housing between a forward latching position with a front wall of said main body portion abutting said front shoulder portions of said housing and a rearward unlatching position with said vertical shoulders on said main body portion abutting said back shoulder portions of said housing, said central cavity in said actuator block extending across the width of a rear portion of said cube-shaped block with a rear wall portion of said block providing said stop bar; said latch bar extends through said opening in said left side wall of said housing and is rotatably mounted thereto with pin means extending through said side wall and said latch bar; and said spring means comprises a tension spring with one end mounted to said back wall of said housing and the other end mounted to said stop arm portion of said latch bar.

8. Apparatus as claimed in claim 1, further comprising lock means selectably actuable to lock said actuating means in said unlatching position.

* * * * *